US009373879B2

(12) United States Patent
Ehyaie

(10) Patent No.: US 9,373,879 B2
(45) Date of Patent: Jun. 21, 2016

(54) COMPACT POWER DIVIDER/COMBINER WITH FLEXIBLE OUTPUT SPACING

(71) Applicant: QUALCOMM Incorporated, San Diego, CA (US)

(72) Inventor: Danial Ehyaie, San Francisco, CA (US)

(73) Assignee: QUALCOMM Incorporated, San Diego, CA (US)

( * ) Notice: Subject to any disclaimer, the term of this patent is extended or adjusted under 35 U.S.C. 154(b) by 353 days.

(21) Appl. No.: 13/678,277

(22) Filed: Nov. 15, 2012

(65) Prior Publication Data

US 2014/0132364 A1 May 15, 2014

(51) Int. Cl.
*H01P 5/12* (2006.01)
*H01P 5/16* (2006.01)

(52) U.S. Cl.
CPC ... *H01P 5/12* (2013.01); *H01P 5/16* (2013.01)

(58) Field of Classification Search
CPC ..... H01P 5/12; H03H 7/46
USPC ..... 333/124–129, 132, 134
See application file for complete search history.

(56) References Cited

U.S. PATENT DOCUMENTS 5,847,625 A 12/1998 Gillette
6,005,442 A 12/1999 Maeda et al.
6,489,859 B1 12/2002 Tahara et al.
2010/0026411 A1* 2/2010 Liu et al. ..... 333/25
2011/0063048 A1 3/2011 Floyd et al.
2012/0274414 A1* 11/2012 Hung et al. ..... 333/125

FOREIGN PATENT DOCUMENTS

JP 2000106501 A 4/2000

OTHER PUBLICATIONS

Horst, et al., "Modified Wilkinson Power Dividers for Millimeter-Wave Integrated Circuits," IEEE Transactions on Microwave Theory and Techniques, vol. 55, No. 11, Nov. 2007, pp. 2439-2446.
International Search Report and Written Opinion—PCT/US2013/069753—ISA/EPO—Jan. 29, 2014.
Noriega F., et al., "Designing LC Wilkinson Power Splitters", RF Design, Primedia Business Magazines & Media, Overland Park, KS, US, vol. 25, No. 8, Aug. 1, 2002, XP001123496, ISSN: 0163-321X.
(Continued)

*Primary Examiner* — Robert Pascal
*Assistant Examiner* — Kimberly Glenn
(74) *Attorney, Agent, or Firm* — James Gutierrez

(57) ABSTRACT

A compact power divider/combiner with flexible port spacing is disclosed. In an exemplary embodiment, an apparatus includes a three port circuit having first, second, and third ports, and a matching circuit configured to couple the second and third ports to ground. The matching circuit includes a first transmission line connected between a first port and a second port, a second transmission line connected between the first port and a third port, a first matching circuit connected between the second port and a first node, a second matching circuit connected between the first node and the third port, and a third matching circuit connected between the first node and a ground.

20 Claims, 5 Drawing Sheets

(56) References Cited

OTHER PUBLICATIONS

Piernas B., et al., "Enhanced miniaturized Wilkinson power divider", 2003 IEEE MTT-S International Microwave Symposium Digest. (IMS 2003). Philadelphia, PA, Jun. 8-13, 2003; [IEEE MTT-S International Microwave Symposium], New York, NY : IEEE, US, vol. 2, Jun. 8, 2003, pp. 1255-1258, XP010645133, DOI: 10.1109/MWSYM.2003.1212597 ISBN: 978-0-7803-7695-3, p. 1255, paragraph I-p. 1256, paragraph II, figures 1-4, abstract.

Yorinks, L.H., "Rectangular, Coaxial-Line. Split-Tee Power Dividers", IEEE—MTTS International Microwave Symposium. Digest, IEEE, US, Jan. 1, 1981, pp. 221-222, XP001368573, ISSN: 0149-645X.

* cited by examiner

COMPACT POWER DIVIDER/COMBINER WITH FLEXIBLE OUTPUT SPACING

BACKGROUND

1. Field

The present application relates generally to the operation and design of analog front ends, and more particularly, to the operation and design of a power divider/combiner for use in an analog front end.

2. Background

Beamforming transceivers having multiple antennas are typically utilized to transmit and receive signals over wireless links operating at millimeter wavelengths, for instance to transmit and receive signals at 60 GHz. Almost all beamforming transceivers utilize a power divider/combiner network. During signal transmission (Tx), the divider/combiner network is used to divide the power of a transmit signal between a plurality of antennas. During signal reception (Rx), the divider/combiner network is used to combine the power of signals received from the plurality of antennas.

One conventional power divider/combiner is referred to as a Wilkinson power divider/combiner. The Wilkinson power divider/combiner is a passive network that can be shared between Tx and Rx functions, has no power consumption, good linearity, and good noise performance. Unfortunately, one problem associated with the Wilkinson power divider/combiner is that it utilizes a large circuit area. Another problem associated with the Wilkinson power divider/combiner is that its circuit implementation typically results in closely spaced port pins, which lead to increased layout complexity.

Accordingly, it would be desirable to have a simple and low cost power divider/combiner that has comparable performance to a Wilkinson divider/combiner, but utilizes smaller circuit area and provides greater flexibility to decrease layout complexity.

BRIEF DESCRIPTION OF THE DRAWINGS

The foregoing aspects described herein will become more readily apparent by reference to the following description when taken in conjunction with the accompanying drawings wherein.

DETAILED DESCRIPTION

The detailed description set forth below in connection with the appended drawings is intended as a description of exemplary embodiments of the invention and is not intended to represent the only embodiments in which the invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, well known structures and devices are shown in block diagram form in order to avoid obscuring the novelty of the exemplary embodiments presented herein.

Figure 1:
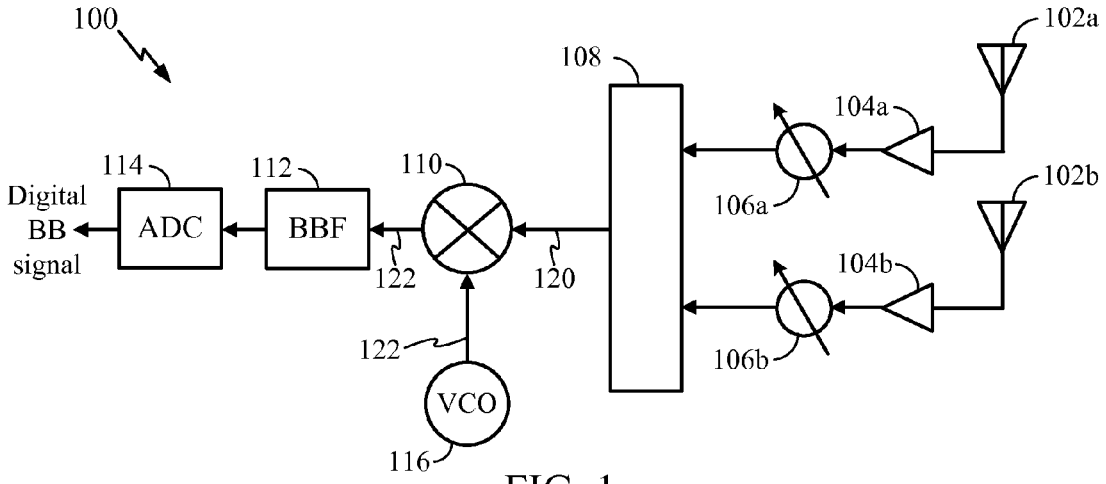
FIG. 1 shows a wideband direct conversion receiver comprising an exemplary embodiment of a power divider/combiner.

FIG. 1 shows a wideband direct conversion receiver 100 employing RF beamforming for use in a wireless device. Multiple antennas 102(*a-b*) each receive wideband RF signals that are input to low noise amplifiers 104(*a-b*). The outputs of the LNAs 104 are input to phase shifters 106(*a-b*) that phase shift these received RF signals with selected amounts of phase shift associated with a desired beam pattern/direction. By providing the appropriate phase shifts, the phase shifters 106 can generate a selected beam pattern/direction that is selected from a plurality of possible beam patterns/direction.

The phase shifted signals output from the phase shifters 106 are combined by a novel divider/combiner 108 to generate an RF wideband beamformed signal 120. The beamformed signal 120 is input to a mixer 110 that performs a down-conversion using a local oscillator (LO) signal 122 generated by a voltage controlled oscillator (VCO) 116. The mixer 110 generates a baseband beamformed signal 122 that is filtered by a baseband filter (BBF) 112 and digitized by an analog to digital filter (ADC) 114 to generate a digital BB signal that can be further processed by the wireless device.

In various exemplary embodiments, the novel divider/combiner 108 is configured to utilize a smaller circuit area and provides greater flexibility for decrease layout complexity when compared to convention divider/combiners. It should also be noted the divider/combiner 108 also operates to process signals flowing the reverse direction, such as during signal transmission. Thus, during transmission, the divider/combiner 108 receives a transmit signal as input and divides the power of the transmit signal to multiple outputs that are connected to multiple phase shifters. The phase shifters then provide selected amounts of phase shift to form a desired transmission beam pattern.

Figure 2:
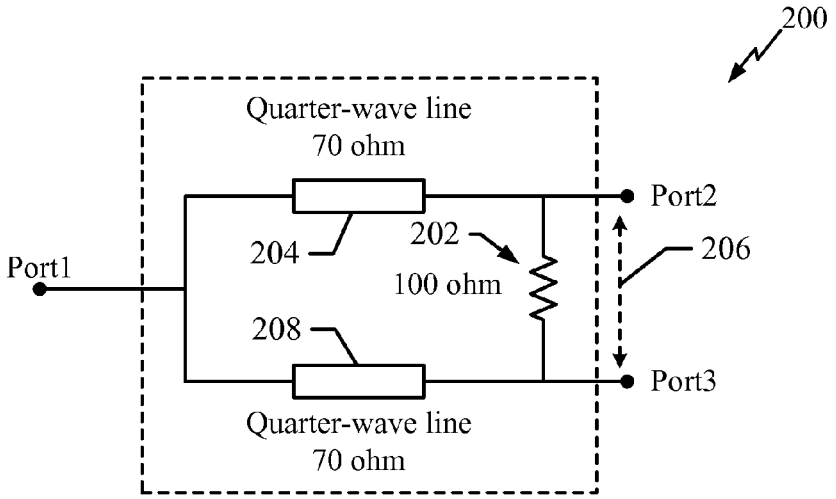
FIG. 2 Prior Art
FIG. 2 shows a detailed diagram of a conventional Wilkinson power divider/combiner.

FIG. 2 shows a conventional Wilkinson power divider/combiner 200. For example, the divider/combiner 200 may be used in the receiver 100 shown in FIG. 1. The divider/combiner 200 comprises two nodes (Port2, Port3) connected together with a 100 ohm resistor 202. The resistor 202 is typically very small, which means that the spacing 206 between two nodes (Port2, Port3) is generally very small. In many implementations, it may not be feasible to have the nodes (Port2, Port3) very close together, and therefore the implementation of the divider/combiner 200 provides less flexibility resulting in increased layout complexity.

The divider/combiner 200 also comprises transmission lines 204, 208 which provide characteristic impedances of 70 ohm. There is a relationship between impedance and size of the transmission lines 204, 208. For example, as the impedance of the transmission line 204 becomes larger the circuit area required for the transmission line 204 may also increase. Therefore, by utilizing 70 ohm transmission lines and the small resistor 202, the divider/combiner 200 has the disadvantages of large circuit area and increased layout complexity. Accordingly, in various exemplary embodiments, the novel power divider/combiner 108 has a smaller circuit area and provides greater flexibility for decreased layout complexity when compared to the Wilkinson divider/combiner 200.

Figure 3:
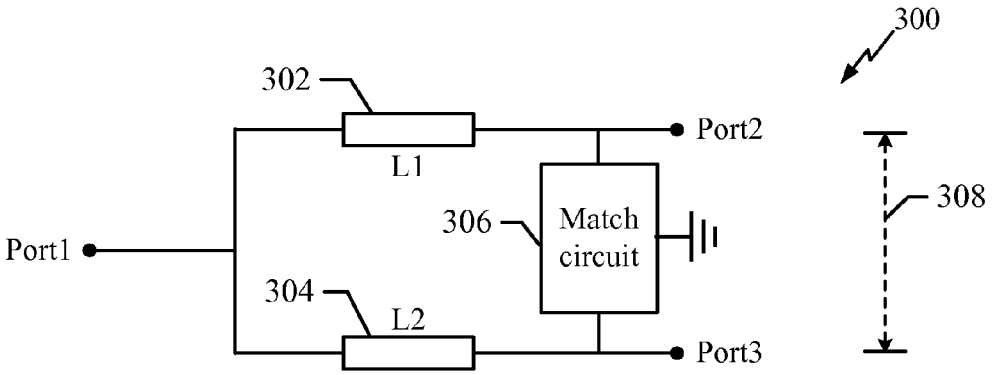
FIG. 3 shows an exemplary embodiment of a divider/combiner.

FIG. 3 shows an exemplary embodiment of a divider/combiner 300. The divider/combiner 300 is configurable to utilize smaller circuit area and provide increased flexibility for decreased layout complexity when compared to the conventional Wilkinson divider/combiner 200 shown in FIG. 2. The divider/combiner 300 comprises a first transmission line 302 connected between a first port (Port 1) and a second port (Port 2). The divider/combiner 300 also comprises a second transmission line 304 connected between Port 1 and a third port (Port 3). The divider/combiner 300 also comprises a matching circuit 306 coupled between coupled between Port 2 and Port 3. The matching circuit 306 is also coupled to ground. Thus, the divider/combiner 300 comprises a three port circuit having first, second, and third ports and includes a matching circuit configured to couple the second and third ports to ground.

In an exemplary embodiment, the matching circuit 306 allows for increased spacing 308 between Port 2 and Port 3 thereby providing increased layout flexibility. Furthermore, the impedances of the transmission lines 302, 304 and the matching circuit 306 are adjustable allowing the size of the transmission lines 302, 304 to be reduced thereby resulting in a smaller overall circuit when compared to the divider/combiner 200 shown in FIG. 2.

Figure 4:
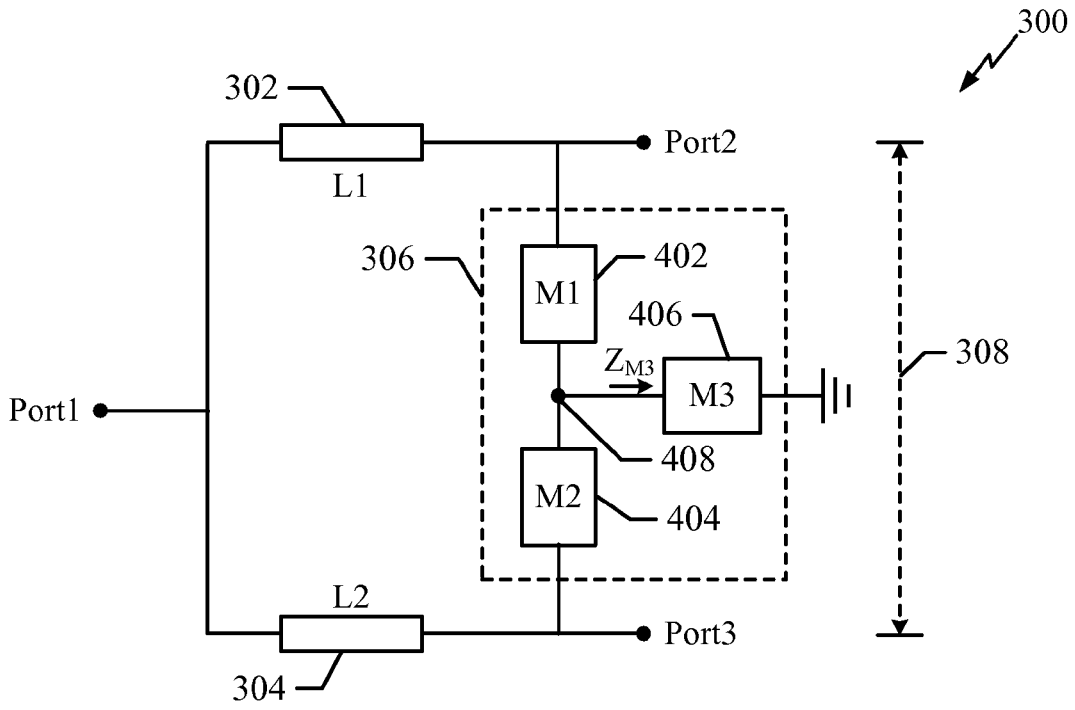
FIG. 4 shows a detailed exemplary embodiment of the divider/combiner shown in FIG. 3.

FIG. 4 shows a detailed exemplary embodiment of a divider/combiner 300. The divider/combiner 300 is configurable to utilize smaller circuit area and provide increased flexibility for decreased layout complexity when compared to the conventional Wilkinson divider/combiner 200 shown in FIG. 2. The transmission line 302 has a length (L1) and a characteristic impedance of ($Z_{L1}$). The line 304 has a length (L2) and a characteristic impedance of ($Z_{L2}$). The matching circuit 306 comprises a first matching circuit (M1) 402 and a second matching circuit (M2) 404 connected in series between Port 2 and Port 3. Third matching circuit (M3) 406 is connected between a first node 408 and a ground. The third matching circuit 406 has an input impedance value defined as ($Z_{M3}$).

In an exemplary embodiment, implementation of the first 402 and second 404 matching circuits provides increased spacing 314 between Port 2 and Port 3 thereby providing increased layout flexibility. The impedances of the transmission lines 302, 304 and matching circuits 402, 404, and 406 can also be adjusted to reduce the size of the transmission lines 302, 304, thereby resulting in a smaller overall circuit when compared to the divider/combiner 200 shown in FIG. 2. Adjustments to the impedances of the divider/combiner 300 to obtain reduced circuit size can be performed based on the results of even and odd mode analysis provided below.

Even Mode Analysis

Figure 5:
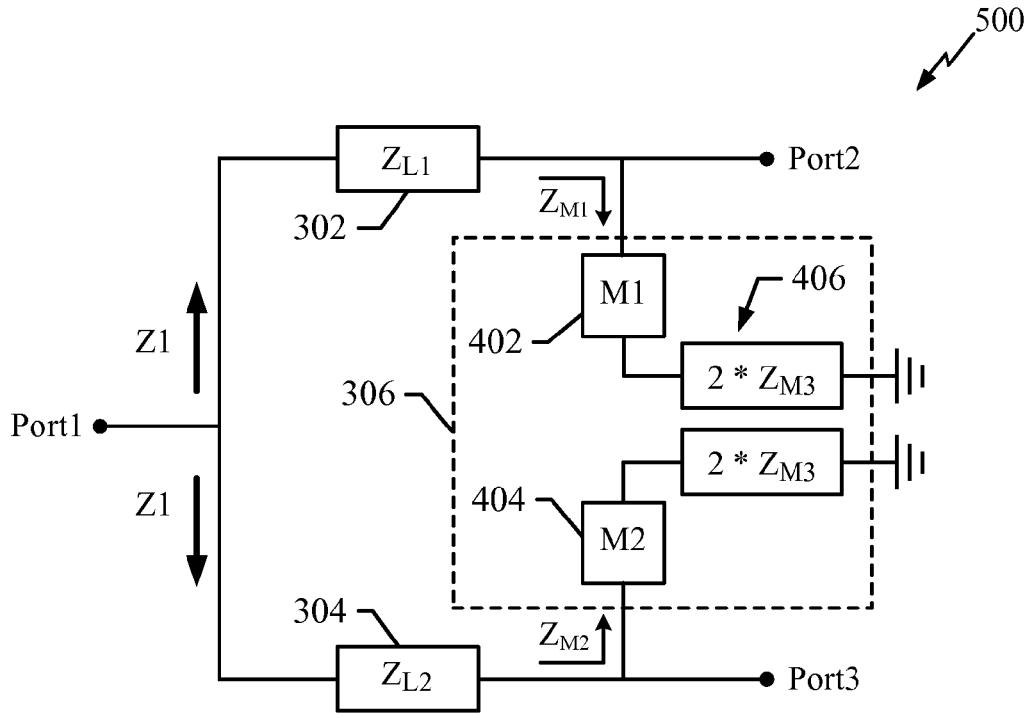
FIG. 5 shows an exemplary even mode representation of the divider/combiner shown in FIG. 4.

FIG. 5 shows an exemplary even mode representation 500 of the divider/combiner 300 with respect to Port 1. In this representation, the impedances of the transmission lines 302, 304 and the matching circuits 402, 404 and 406 are configured so that they combined to match an impedance (Z1) seen at Port 1. As illustrated in FIG. 5, the matching circuit M3 406 is divided to provide two separate impedances that combined to form the input impedance $Z_{M3}$.

In an exemplary embodiment, the above impedances are set so that the impedance Z1 is equivalent to 100 ohms, and thus the combined impedance seen at Port 1 would be 50 ohms. It should be noted that a range of impedance values can be used to obtain a combined impedance seen at Port 1 that is different from 50 ohms By adjusting the impedances of the matching circuits M1 402, M2 404 and M3 406, it is possible to adjust the size of the transmission lines 302, 304 while achieving the desired Port 1 impedance. For example, the size of the transmission lines 302, 304 can be reduced by adjusting the impedances of the matching circuits 402, 404, and 406 to achieve the desired combined impedance at Port 1. As a result, the transmission lines 302, 304 may be set to provide smaller impedances and have corresponding smaller sizes.

Figure 6:
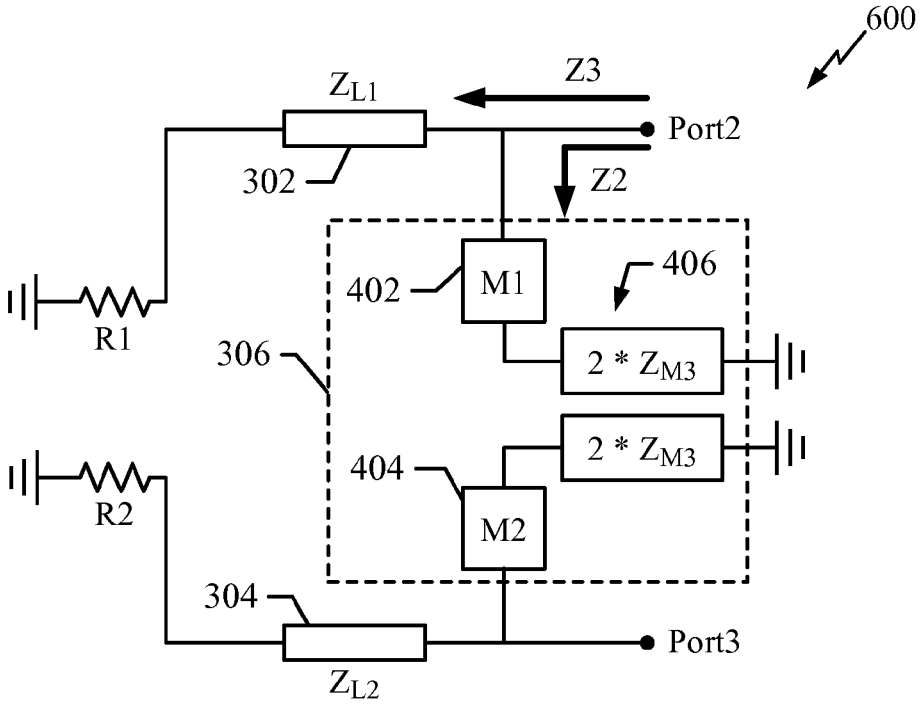
FIG. 6 shows an exemplary even mode representation of the divider/combiner shown in FIG. 4.

FIG. 6 shows an exemplary even mode representation 600 of the novel divider/combiner 300 with respect to Ports 2 and 3. Referring to Port 2, the impedances of the transmission lines 302, 304 and the matching circuits 402, 404 and 406 are configured so that impedances (Z2 and Z3) seen at Port 2 form a parallel combination to obtain a desired impedance value. For example, if the desired impedance at Port 2 is 50 ohms then the parallel combination of the impedances Z2 and Z3 is set to 50 ohms as follows.

50=Z2IIZ3 (parallel combination of Z2 and Z3)

Thus, the size of the transmission lines 302, 304 can be reduced by adjusting the impedances of the matching circuits 402, 404, and 406 to achieve the desired combined impedance at Port 2. As a result, the transmission lines 302, 304 may be set to provide smaller impedances and have corresponding smaller sizes.

Odd Mode Analysis

Figure 7:
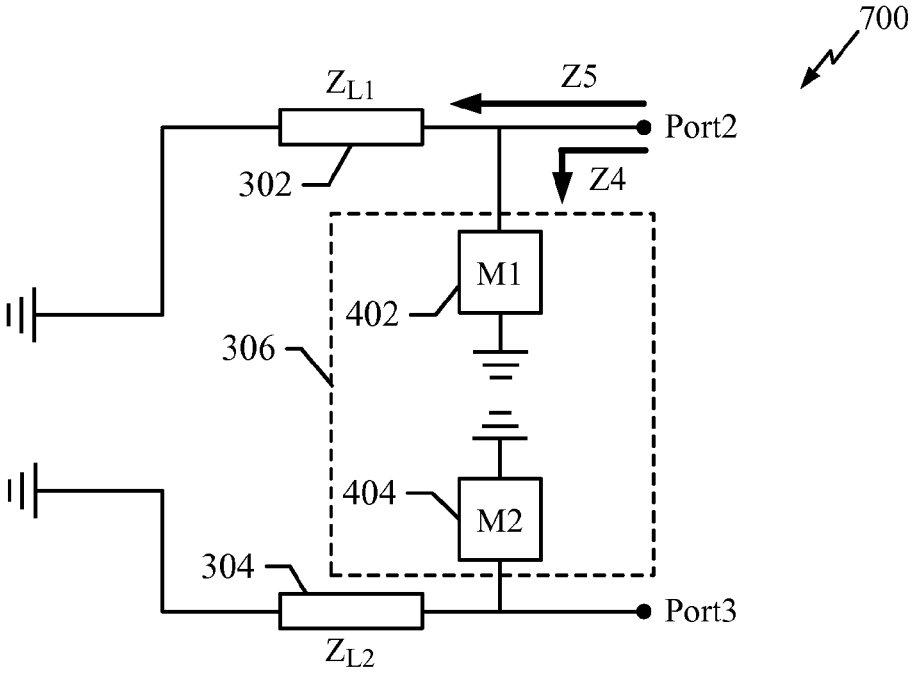
FIG. 7 shows an exemplary odd mode representation of the divider/combiner shown in FIG. 4.

FIG. 7 shows an exemplary odd mode representation 700 of the novel divider/combiner 300 with respect to Ports 2 and 3. Referring to Port 2, the matching circuit 406 is set to have zero impedance and is therefore replaced with a short to ground. The impedances of the lines 302, 304 and the matching circuits 402, 404 are configured so that impedances (Z4 and Z5) seen at Port 2 form a parallel combination to obtain a desired impedance value. For example, if the desired impedance at Port 2 is 50 ohms then the parallel combination of the impedances Z4 and Z5 is set to 50 ohms as follows.

50=Z4IIZ5 (parallel combination of Z4 and Z5)

Therefore, the novel divider/combiner 300 can be configured by adjusting impedances of the matching circuits 402, 404, and 406 to reduce the impedance of the transmission lines 302, 304, and thereby reduce the required chip area of the transmission lines 302 and 304. The divider/combiner 300 is also configured to increase the port spacing between Ports 2 and 3 to provide greater layout flexibility as compared to the divider/combiner 200 shown in FIG. 2.

Figure 8:
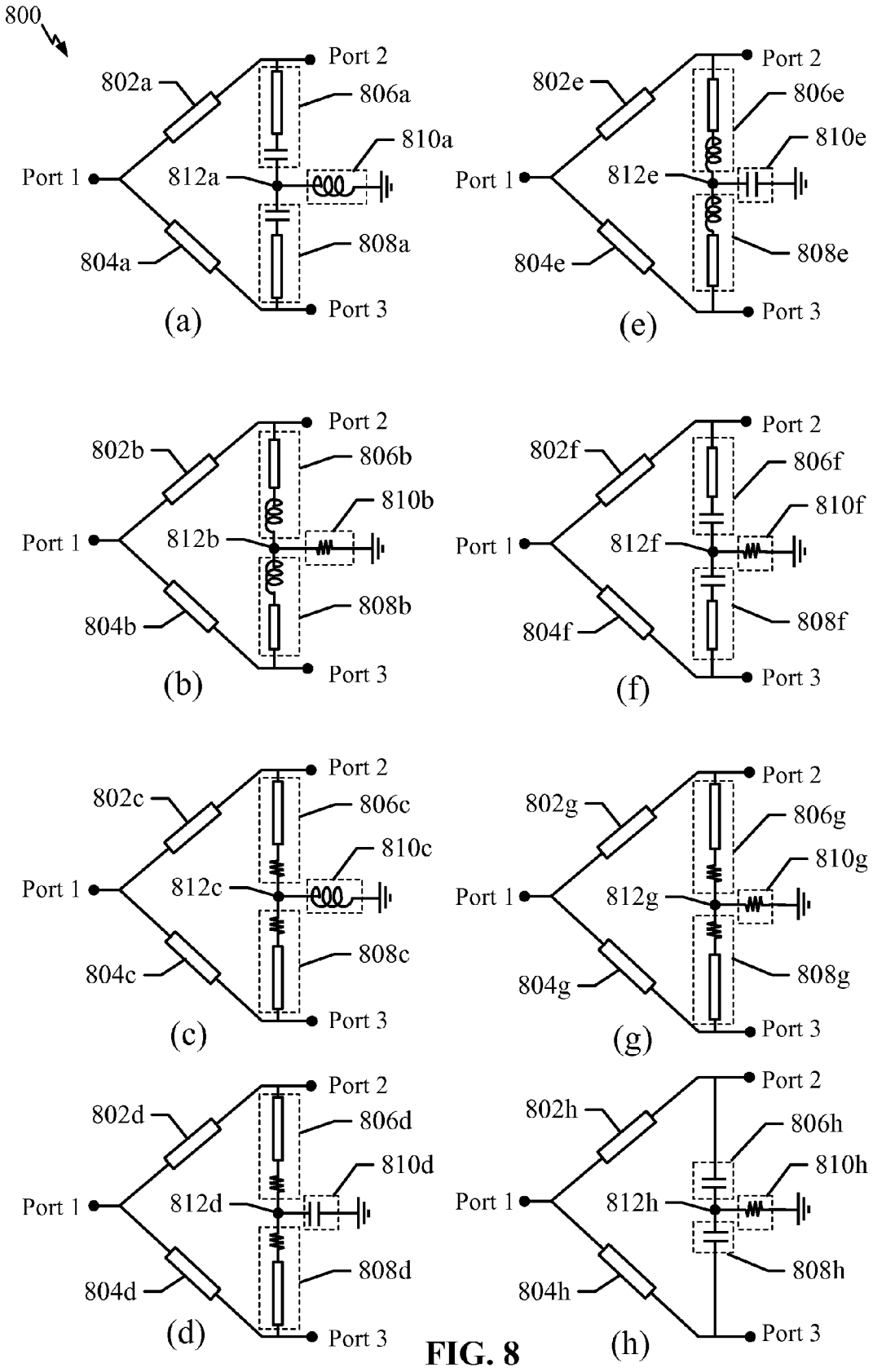
FIG. 8 shows exemplary embodiments of divider/combiner configurations.

FIG. 8 shows exemplary embodiments of divider/combiner configurations 800. In each configuration, Port 1 is coupled to Port 2 by transmission line 802 and Port 1 is coupled to Port 3 by transmission line 804. A first matching circuit 806 is coupled between Port 2 and node 812 and a second matching circuit 808 is coupled between Port 3 and the node 812. A third matching circuit 810 is coupled between the node 812 and ground.

In the various configurations, the matching circuits 806, 808 and 810 comprise transmission lines, inductors, capacitors and/or resistors. For example, the matching circuit 806*a* comprises a transmission line and a capacitor, the matching circuit 806*b* compromises a transmission line and an inductor, and the matching circuit 806*c* comprises a transmission line and a resistor. It should be noted that the matching circuits 806 and 808 need not comprises a transmission line. For example, the matching circuits 806*h* and 808*h* comprises only capacitors.

All the novel divider/combiner configurations shown in FIG. 8 can be configured by adjusting impedances of the matching circuits 806, 808, and 810 to reduce the required chip area of the transmission lines 802 and 804 and to increase the port spacing between Ports 2 and 3 to provide greater layout flexibility as compared to the divider/combiner 200 shown in FIG. 2.

Figure 9:
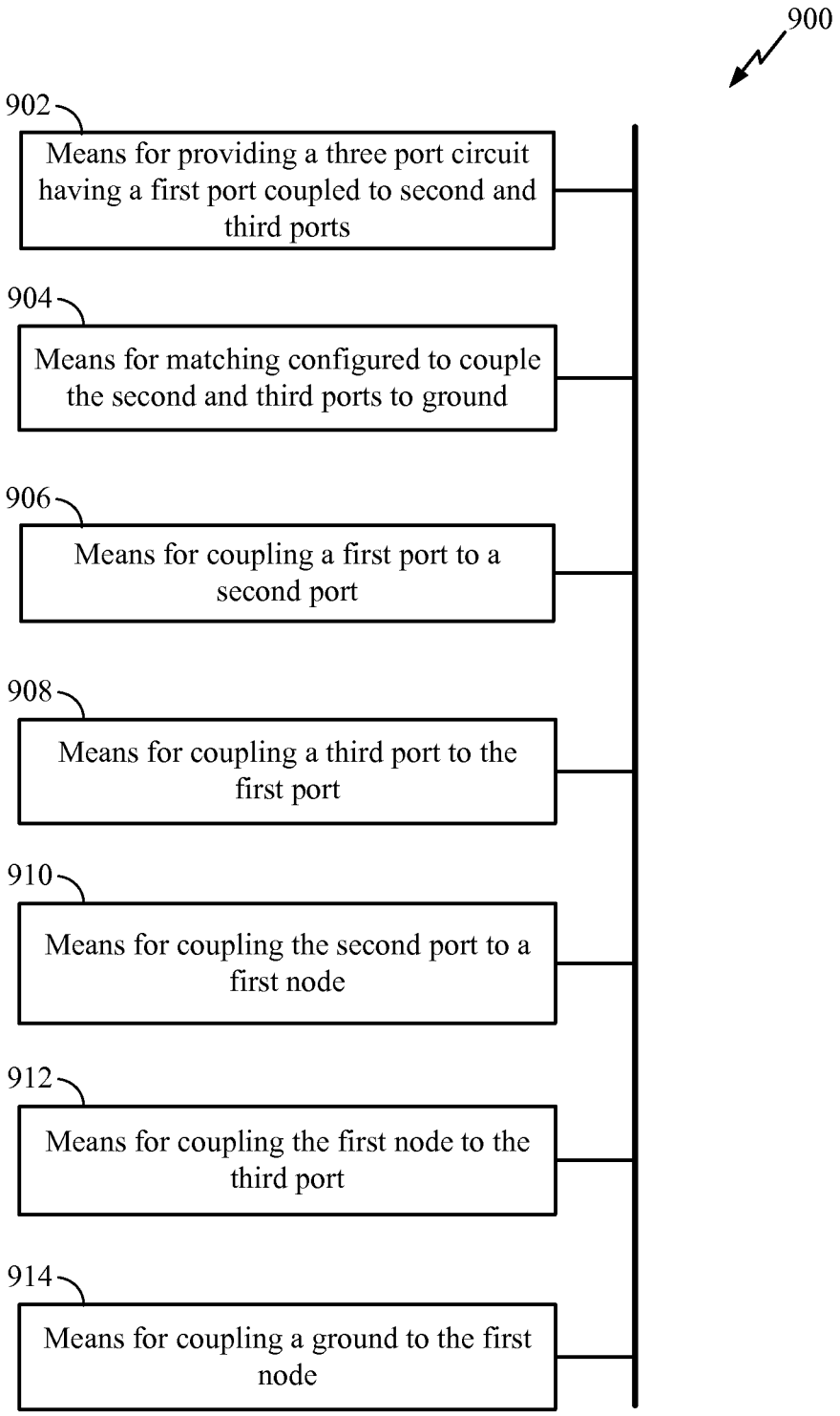
FIG. 9 shows an exemplary embodiment of a divider/combiner apparatus.

FIG. 9 shows an exemplary embodiment of a divider/combiner apparatus 900. For example, the apparatus 900 is suitable for use as the divider/combiner 300 shown in FIG. 4 or the divider/combiner 108 shown in FIG. 1. In an aspect, the apparatus 900 is implemented by one or more modules configured to provide the functions as described herein. For example, in an aspect, each module comprises hardware and/or hardware executing software.

The apparatus 900 comprises a first module comprising means (902) for providing a three port circuit having a first port couple to second and third ports, which in an aspect comprises the power divider/combiner 300.

The apparatus 900 comprises a second module comprising means (904) for matching configured to couple the second and third ports to ground, which in an aspect comprises the matching circuit 306.

The apparatus 900, the means 904 for matching comprises a third module comprising means (906) for coupling a first port to a second port, which in an aspect comprises the transmission line 302.

The apparatus 900, the means 904 for matching also comprises a fourth module comprising means (908) for coupling a third port to the first port, which in an aspect comprises the transmission line 304.

The apparatus 900 the means 904 for matching also comprises a fifth module comprising means (910) for coupling the second port to a first node, which in an aspect comprises the matching circuit 402.

The apparatus 900 the means 904 for matching also comprises a sixth module comprising means (912) for coupling the first node to the third port, which in an aspect comprises the matching circuit 404.

The apparatus 900, the means 904 for matching also comprises a seventh module comprising means (914) for coupling a ground to the first node, which in an aspect comprises the matching circuit 406.

Those of skill in the art would understand that information and signals may be represented or processed using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof. It is further noted that transistor types and technologies may be substituted, rearranged or otherwise modified to achieve the same results. For example, circuits shown utilizing PMOS transistors may be modified to use NMOS transistors and vice versa. Thus, the amplifiers disclosed herein may be realized using a variety of transistor types and technologies and are not limited to those transistor types and technologies illustrated in the Drawings. For example, transistors types such as BJT, GaAs, MOSFET or any other transistor technology may be used.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both non-transitory computer storage media and communication media including any medium that facilitates transfer of a computer program from one place to another. A non-transitory storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The description of the disclosed exemplary embodiments is provided to enable any person skilled in the art to make or use the invention. Various modifications to these exemplary embodiments will be readily apparent to those skilled in the art, and the generic principles defined herein may be applied to other embodiments without departing from the spirit or scope of the invention. Thus, the invention is not intended to be limited to the exemplary embodiments shown herein but is to be accorded the widest scope consistent with the principles and novel features disclosed herein.

What is claimed is:

1. An apparatus comprising:

a three port circuit having a first port coupled to a second and third ports; and a matching circuit connected in series between the second and third ports, the matching circuit configured to couple the second and third ports to ground, the apparatus forming a bidirectional power combiner/divider.

2. The apparatus of claim 1, the matching circuit comprising:

a first matching circuit coupled between the second port and a first node;

a second matching circuit coupled between the first node and the third port; and a third matching circuit coupled between the first node and the ground.

3. The apparatus of claim 2, further comprising:

a first transmission line coupled between the first port and the second port; and a second transmission line coupled between the first port and the third port.

4. The apparatus of claim 3, the first and second transmission lines and the first, second, and third matching circuits configured to provide a combined impedance value seen at the first port that is matched to a selected characteristic impedance value.

5. The apparatus of claim 4, the selected characteristic impedance value is set to 50 ohms.

6. The apparatus of claim 3, the first, second, and third matching circuits configured to adjust sizes of the first and second transmission lines.

7. The apparatus of claim 2, the first and second matching circuits are configured to increase spacing between the second and third ports.

8. The apparatus of claim 3, the first and second transmission lines and the first, second, and third matching circuits configured to provide a combined impedance value seen at the second port that is matched to a selected characteristic impedance value.

9. The apparatus of claim 8, the selected characteristic impedance value is set to 50 ohms.

10. The apparatus of claim 1, the apparatus forming a bidirectional passive power combiner/divider.

11. The apparatus of claim 10, the bidirectional passive power combiner/divider configured for use in a transceiver.

12. An apparatus comprising:

means for providing a three port circuit having a first port coupled to second and third ports; and means for matching connected in series between the second and third ports, the means for matching configured to couple the second and third ports to ground, the apparatus forming a bidirectional power combiner/divider.

13. The apparatus of claim 12, the means for matching comprising:

means for coupling the second port and a first node;

means for coupling the first node and the third port; and means for coupling the ground to the first node.

14. The apparatus of claim 13, further comprising:

means for coupling a first transmission line between the first and second ports; and means for coupling a second transmission line between first and third ports.

15. The apparatus of claim 14, the first transmission line, the second transmission line, the means for coupling the second port, the means for coupling the first node, and the means for coupling the ground configured to provide a combined impedance value seen at the first port that is matched to a selected characteristic impedance value.

16. The apparatus of claim 14, the means for coupling the second port, the means for coupling the first node, and the means for coupling the ground configured to adjust sizes of the first and second transmission lines.

17. The apparatus of claim 14, the means for coupling the second port, the means for coupling the first node configured to increase spacing between the second and third ports.

18. The apparatus of claim 14, the first transmission line, the second transmission line, the means for coupling the second port, the means for coupling the first node, and the means for coupling the ground configured to provide a combined impedance value seen at the second port that is matched to a selected characteristic impedance value.

19. The apparatus of claim 12, the apparatus forming a bidirectional passive power combiner/divider.

20. The apparatus of claim 19, the bidirectional passive power combiner/divider configured for use in a transceiver.

* * * * *